US005957060A

United States Patent [19]

Rosenband

[11] Patent Number: 5,957,060

[45] Date of Patent: Sep. 28, 1999

[54] SHELVING SYSTEM

[75] Inventor: Phillip Rosenband, Hammond, Ind.

[73] Assignee: Morgan Marshall Industries, Inc., Chicago Heights, Ill.

[21] Appl. No.: 09/065,981

[22] Filed: Apr. 24, 1998

[51] Int. Cl.[6] ..... A47B 9/00

[52] U.S. Cl. ..... 108/107; 211/187

[58] Field of Search ..... 108/106, 107, 108/192, 193, 147.16, 147.17, 147.15, 147.11, 147.12; 211/135, 187, 190, 207, 209, 90.02

[56] References Cited

U.S. PATENT DOCUMENTS

| | | | |
|---|---|---|---|
| 1,871,972 | 8/1932 | Fenstermaker | 108/107 X |
| 2,935,210 | 5/1960 | Cohen | 211/208 X |
| 3,294,250 | 12/1966 | Evans | 108/147.15 X |
| 3,479,974 | 11/1969 | Ferdinand et al. | 108/107 X |
| 4,742,782 | 5/1988 | Miller | 108/107 |
| 4,821,649 | 4/1989 | Andersson | 108/107 |
| 5,735,221 | 4/1998 | Benayon | 108/107 |

*Primary Examiner*—José V. Chen
*Attorney, Agent, or Firm*—Laff, Whitesel, Conte & Saret, Ltd.

[57] ABSTRACT

A shelving system employing an array of vertical standards defining vertically arranged pockets on the inwardly facing surface of each and a shelf. The shelf is rectangular and is formed from a single sheet of metal to which shoulder rivets are secured. The rivet heads extend outwardly of the side edges of the shelf and are arrayed to cooperate with a set of pockets to support and retain a shelf in association with the array of vertical standards.

4 Claims, 5 Drawing Sheets

SHELVING SYSTEM

BACKGROUND OF THE INVENTION

A wide variety of shelving systems employing posts and shelves removably securable thereto are known and used. For a self-supporting shelving system, typically four vertical standards are employed, near each of the four shelf corners. Each vertical standard typically defines a plurality of vertically spaced recesses which are configured to receive cooperating hooks or other members to support a shelf corner thereat. Most such standards employ recesses formed in the front face of the standard so that hooks or the like may pass through the front face into the standard. Such arrangements work well when shelves or other members are brought against the standards intermediate the lengths of the shelves.

However, in some systems the shelves are disposed within the space defined by the inner surfaces of an array of four standards. In those cases, typical hooks cannot be used in the front faces of the standards to support the shelf. As such, in one existing product, each of four standards is provided with pockets which extend inwardly of the array of standards from the respective inner surfaces of the standards. These pockets, if their vertical spacing is close, say at spacing of two inches, severely restrict the overall thickness of the shelves which can be used and have typically required expensive sheet metal formations to provide complementary configurations for facilitating use of the shelf with the pockets. Further, such systems have required and used specially formed shelves employing a special sheet metal bracket at each end of the shelf and a composition board secured thereto as the major shelf member.

It would be desirable to provide an improved shelving system employing vertical standards each with a series of vertically spaced pockets formed on their inner surfaces and shelves, and where each shelf is formed from a single sheet of metal to which laterally projecting rivets are secured, one at each corner of the shelf, for securance in a set of four pockets in the associated rectangular array of vertical standards.

SUMMARY OF THE INVENTION

In accordance with the present invention, a shelving system having a plurality of vertical standards arranged in a rectangular array is provided. Each standard has an inwardly facing inner surface defining a vertically spaced series of upwardly opening pockets, each of the pockets on each standard projecting inwardly of the rectangular array and inwardly of the array from the inner surface, the pockets defining formations for engaging a shelf, and whereby a set of pockets, one on each of the standards, may be used to engage, support and retain a shelf at each of its four corners on a rectangular array. The system further includes a shelf, the shelf being substantially rectangular and being integrally formed from a single sheet of steel to provide a main shelf surface and front, rear and opposite side edges, the front and rear edges having downwardly extending front and rear hollow box-beam reinforcing formations, and the side edges having downwardly projecting side panels, the shelf having four corners, and further having flaps extending from the front and rear edges and overlapping the side panels at each of the four corners. In each of the four corners, a pair of aligned openings, one formed in each side panel and overlapping flap, are provided. A circular rivet is secured in each of the pair of aligned openings, each rivet having a head, the rivet head projecting outwardly of the side edge and a set of four rivets being positioned to overlie and engage a set of pockets, and to cooperate therewith to support a shelf in the set of pockets, and to retain a shelf in the rectangular array. Preferably the rivets are shoulder rivets and each pocket formation includes a pair of generally vertical edges and a lower support edge extending between the lower reaches of the vertical edges and wherein the distance between the vertical edges is less than the diameter of the rivet head, whereby when the heads are moved downwardly and positioned in the pockets, they will be restrained against movement inwardly of the array and out of the pockets. Desirably, the rivets are rivets having shoulders, and the diameters of the shoulders are less than the distance between the vertical edges.

Further objects, features and advantages of the present invention will become apparent from the following description and drawings.

DETAILED DESCRIPTION OF THE PREFERRED EMBODIMENT

Figure 1:
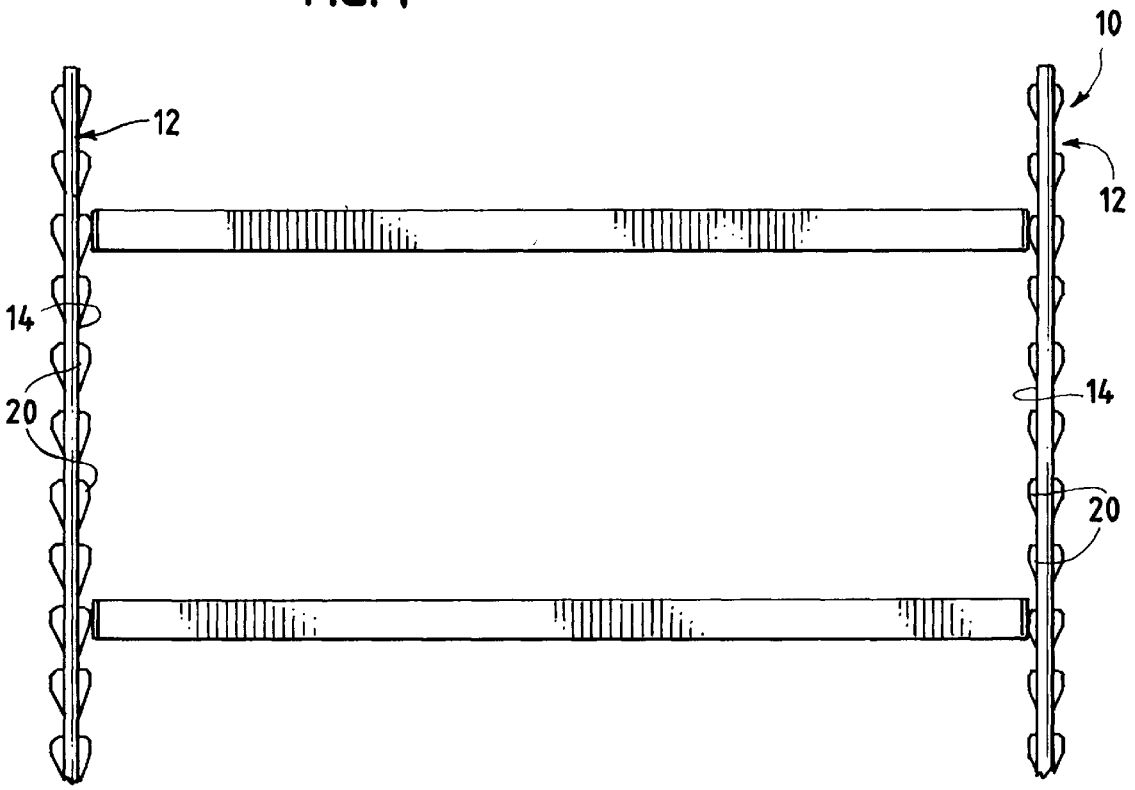
FIG. 1 is a front elevational view of a shelving system in accordance with the present invention.
Figure 2:
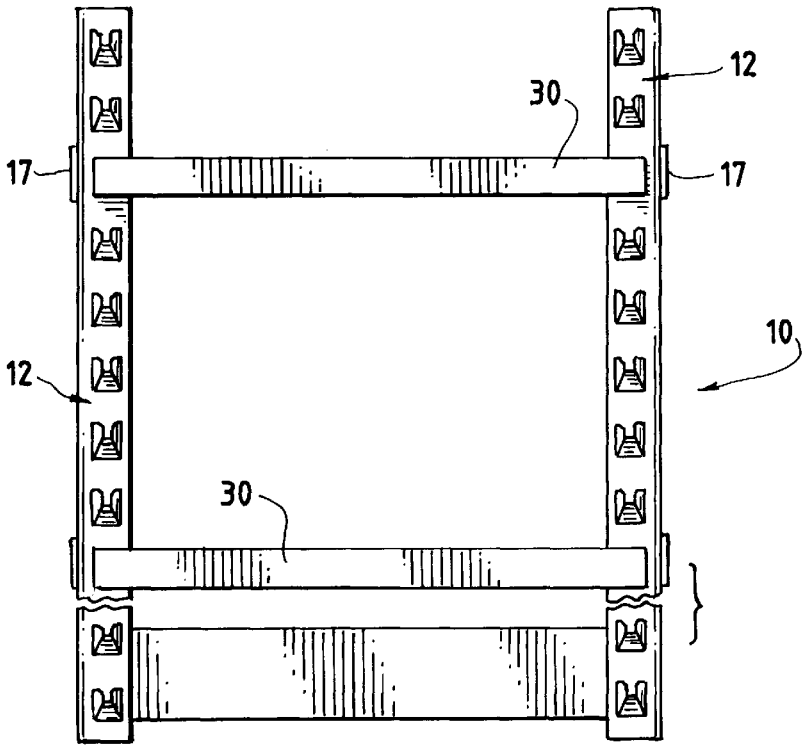
FIG. 2 is a cross-sectional view taken substantially along line 2—2 of FIG. 1.
Figure 3:
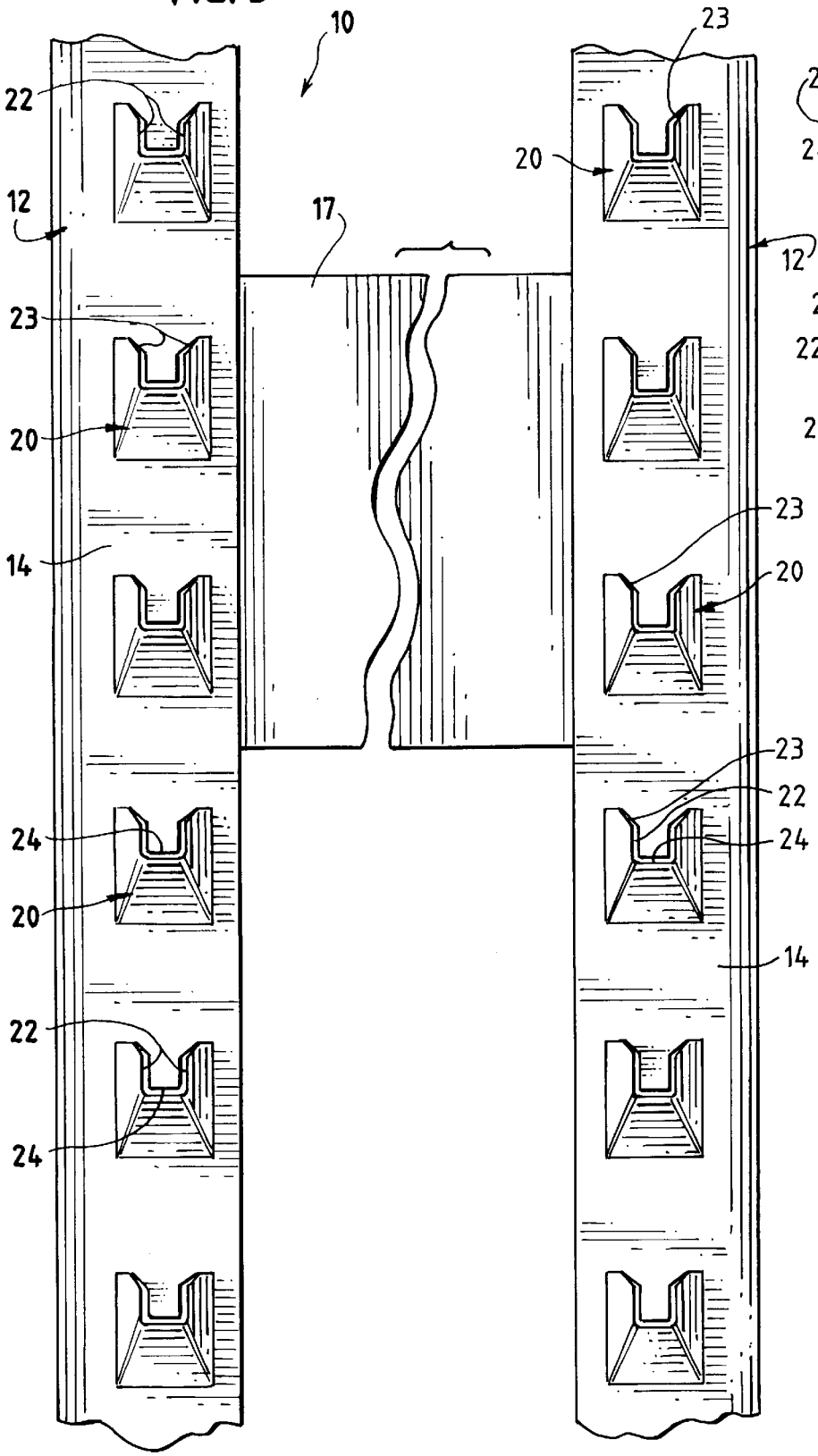
FIG. 3 is an enlarged fragmentary view of a portion of FIG. 2.
Figure 4:
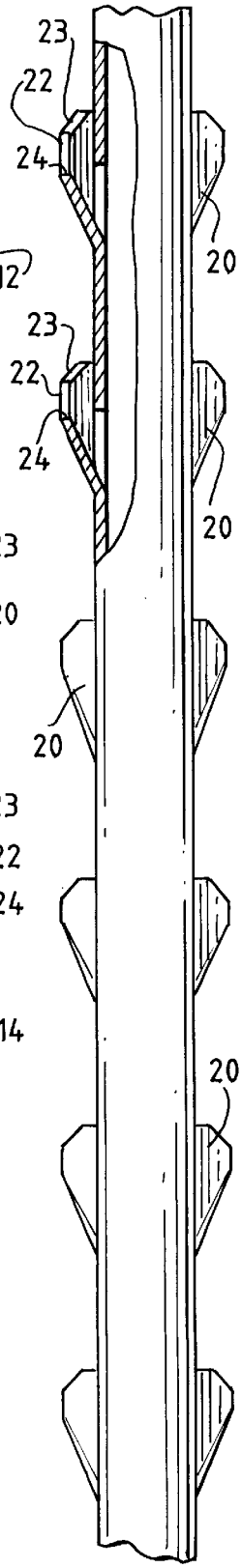
FIG. 4 is a fragmentary view of a portion of FIG. 1.

Referring now to the drawings, a shelving system 10 of the present invention may employ four vertical columns or standards 12 arranged in a rectangular array. Each standard 12 may be floor supported and may be of a suitable height, such as four, six or eight feet in length. Each standard 12 may be generally U-shaped in plan view and may be made of galvanized sheet metal of about 16 gauge. The front face of the standard 12 may be about ⅝" wide and each side surface may be about 1½" deep. Each standard 12 has an inwardly facing inner side surface 14.

Each inner side surface 14 defines a series of vertically spaced pockets 20 which open upwardly. Pockets 20 may be disposed along the major portion of the lengths of standards 12 and may be spaced vertically apart at two-inch intervals. Each pocket 20 projects inwardly of the rectangular array and is formed outwardly of the inner surface 14 to provide a pair of vertical pocket segments, each defining a vertical edge 22 spaced from the opposite edge 22 and a horizontal edge 24 at the lower reaches of edges 22. Edges 22 and 24 are spaced away from the inner surfaces 14 by about ⅛ inch. Each vertical edge 22 terminates upwardly in an outwardly and upwardly inclined edge 23. Although a set of four standards 12 requires pockets on one inner surface only of each of them, for convenience or where the standards 12 may be used to form a series of laterally adjacent shelf sections, both side surfaces of the standards 12 may be provided with upwardly opening pockets 20.

Where desired, tie rods, stringers 17 or other elements may be used to tie the front and rear standards to each other and to rigidify the four standards 12 to provide a suitably rigid rectangular array. As is apparent, the standards 12 are spaced and arranged to support and retain a series of vertically spaced shelves via each corner of the shelves.

Figure 5:
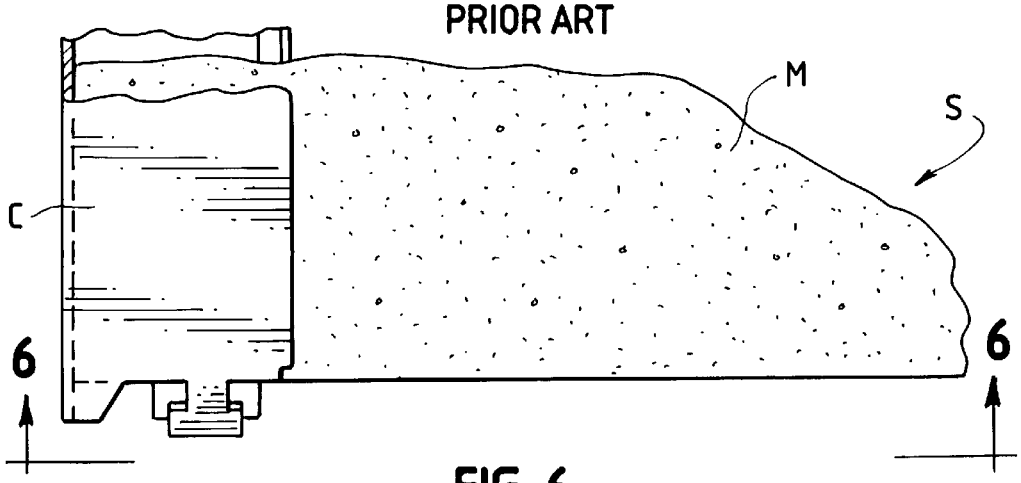
FIG. 5 PRIOR ART
FIG. 5 is a plan view of a prior art shelf.
Figure 6:
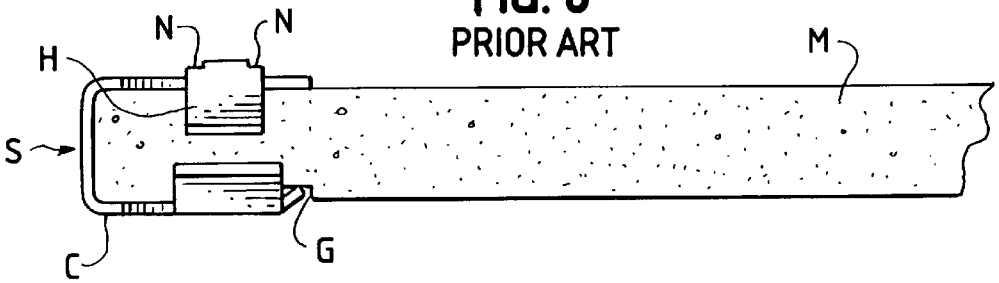
FIG. 6 PRIOR ART
FIG. 6 is an end view of the prior art shelf of FIG. 5.
Figure 7:
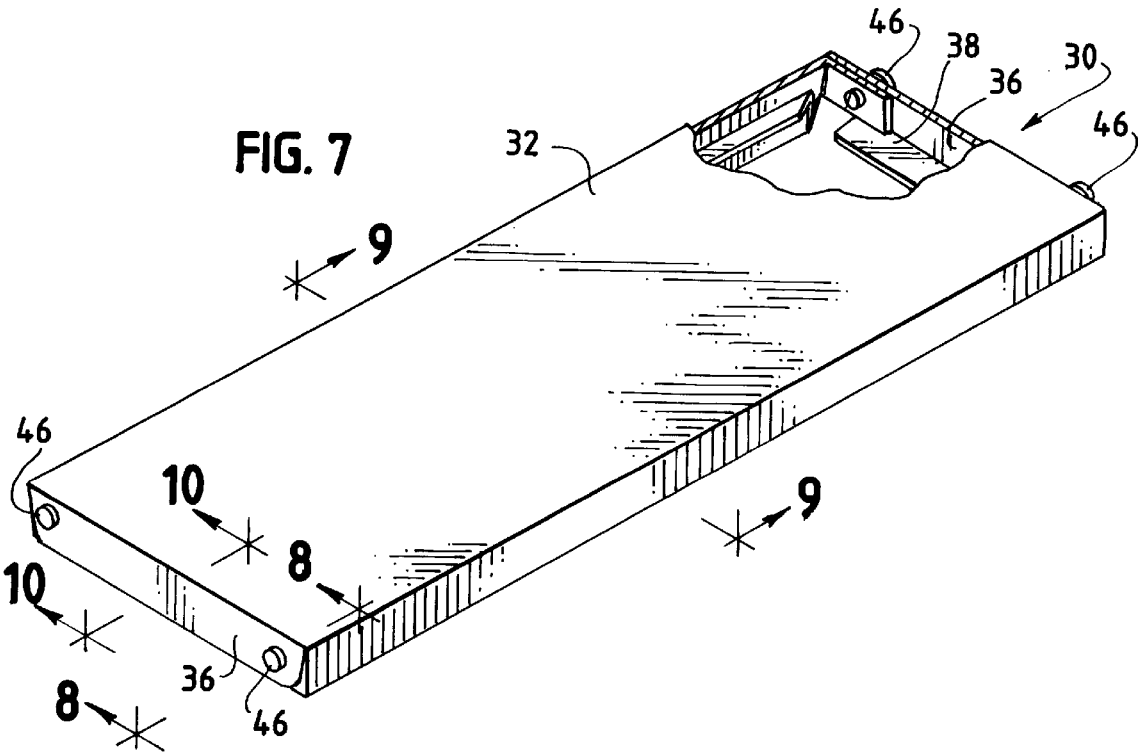
FIG. 7 is a perspective view of a shelf of FIG. 1 in accordance with the present invention.
Figure 7A:
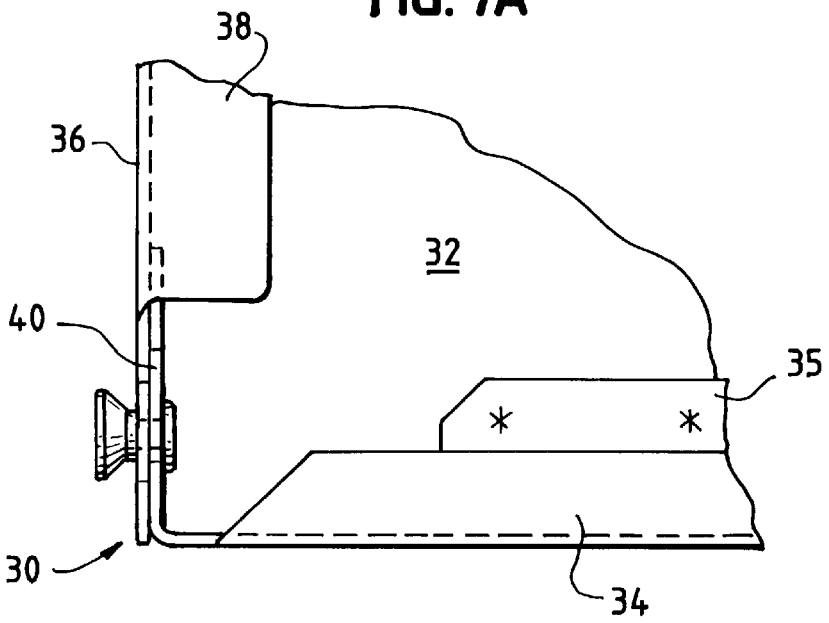
FIG. 7A is a bottom plan view of a portion of FIG. 7.

As shown in FIGS. 5 and 6, prior art shelves used with such standards have been made of multiple pieces requiring assembly to each other and special routing of the shelf member itself. Thus, prior art shelves S typically employed a particle board member M routed to provide longitudinal grooves G, one at each of the front and the rear of the shelf. At each of the front and rear, a specially formed channel C is provided. Each end of the channel C is stamped and formed to provide a hook H having a width (from front to rear) greater than the distance between the vertical pocket edges 22, but with notches N at the top of the hook H spaced apart a distance less than the distance between the vertical pocket edges so that the top of hook H may pass between the edges 22 to permit the hook H to rest on the horizontal pocket edge 24. Because of the substantial loads may be applied to hooks H, it is necessary to form the channels C of a very heavy gauge steel.

In accordance with the present invention, conventional shelving of a relatively light gauge steel and formed of a single piece and folded in a conventional manner may be substituted for the complicated prior art shelving employed in such prior art systems. The shelves of the present invention also satisfy the shelf installation restrictions imposed by the presence of the inwardly extending pockets 20. It will be appreciated from the drawings that prior art shelving systems with inwardly extending lateral pockets provide very little leeway between the inner surfaces 14 of the standards 12 and the lateral extension of the hooks H on the opposite sides of a shelf. As such, shelves such as prior art shelves S must be installed by carefully pushing the shelf rearwardly between the vertically adjacent pockets 20 (which project inwardly) and then dropping the hooks H of the prior art shelves S into the pockets. This limits the permissible vertical thickness of the shelves in the zone of the pockets and requires laterally projecting hooks H which must extend substantially to the inner surfaces 14 of opposite standards 12 so that the vertical projections of hooks at the opposite sides of a shelf overlie the lateral projections of an opposite pair of pockets. Thus, substantial care in proportioning and aligning the prior art shelves S and the standards 12 is required.

Each shelf 30 of the present invention is substantially rectangular and, as stated, is integrally formed from a single sheet of a suitable, relatively light-weight, thin gauge steel, such as of 22 gauge steel, and is folded conventionally to provide a main shelf surface 32 having front and rear hollow box beam-like reinforcing formations 34 at the front and rear edges. At the front and back, each beam terminates in a horizontally extending flange 35 which is spot-welded to the underside of main shelf surface 32. Each end or side of shelf 30 comprises a downwardly projecting side panel 36 terminating at its lower edge in an inwardly projecting side panel return 38. At each of the four corners of the shelves, each shelf includes a folded flap 40 which extends along complementary edges of the side panels 36. Shelves 30, such as these, are easy to form by stamping, folding and forming from an integral blank and have good load-bearing characteristics.

Figure 8:
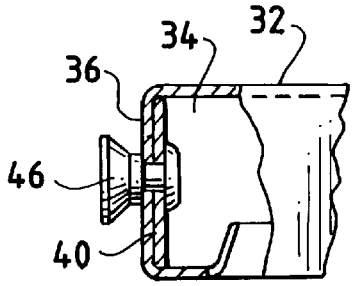
FIG. 8 is an enlarged sectional view taken substantially along line 8—8 of FIG. 7.
Figure 9:
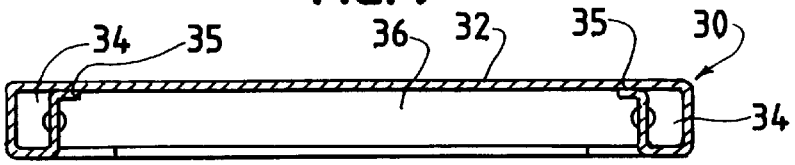
FIG. 9 is a sectional view of FIG. 7 taken substantially along line 9—9 thereof.
Figure 10:
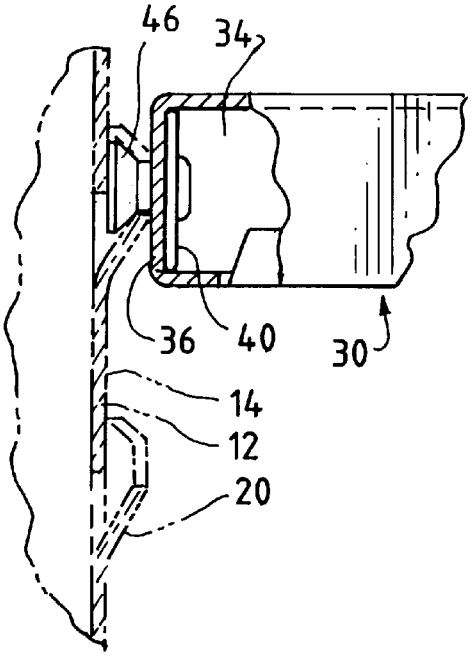
FIG. 10 is a sectional view of FIG. 7 taken substantially along line 10—10 thereof.
Figure 11:
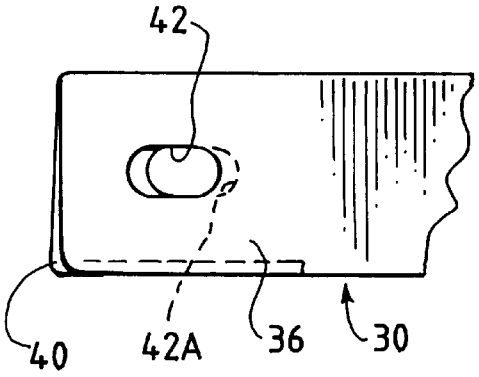
FIG. 11 is an enlarged fragmentary view of a corner portion of FIG. 7.
Figure 12:
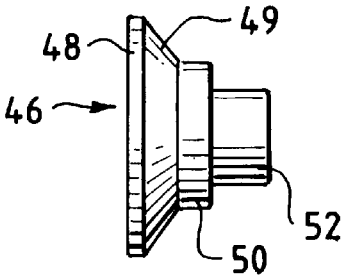
FIG. 12 is a side view of a shoulder rivet used in making the shelf of FIG. 7.
Figure 13:
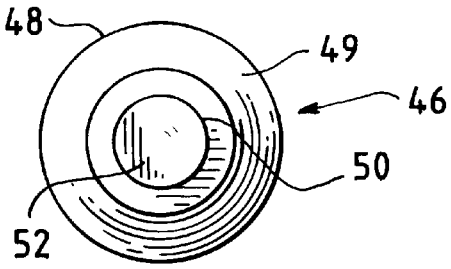
FIG. 13 is a rear view of FIG. 12.

According to the present invention, during the forming, stamping and folding of shelf 30, openings 42 are provided in the side edges of side panels 36 along with complementary holes or openings 42A formed in the flaps 40. Pairs of openings 42, 42A are substantially aligned with each other at each of the four corners, and each pair mounts and secures a shoulder rivet 46 which projects outwardly of the side edges of the shelf. Shoulder rivets 46 are circular and comprise a head 48, a shoulder 50 and a shank 52. Head 48 of an exemplary rivet 46 is 0.5 inch in diameter and has an inwardly tapering surface 49 at its rear. It tapers to the shoulder 50 which may have a diameter of 0.3125 inch and a depth of 0.065 inch. Finally, the shank 52 has a diameter of 0.1875 inch and a length of 0.1875 inch. The shank diameter is very slightly less than the vertical dimension of the openings 42, 42A. To secure the rivets 46 to the shelves 30, the rivets 46 are positioned in the openings 42, 42A with the shoulders 50 against the surface of the shelf panel 36 surrounding the openings 42. The shank of each rivet 46 is upset so that the enlarged upset end 53 of the shank 52 and the opposite shoulder 50 of the rivet 46 grip the side of the shelf panel 36 (and a flap 40) between them. (See FIG. 8.) In this manner, each corner of the shelf is provided with an outwardly projecting rivet head 48.

A shelf 30 thus made may then be moved generally in the plane of its thickness between pockets 20 in an array of upstanding standards to which the shelf is to be secured until the four outwardly projecting rivet heads 48 at the four corners of the shelf 30 overlie a set of four pockets 20. The shelf 30 may then be lowered, with the shoulders 50 and tapering surface 49 of the head camming the shelf slightly forwardly or rearwardly, as appropriate, as they descend between the inclined edges 23 and into the throat provided by the vertical pocket edges 22. Because the dimensions of the shoulder 50 and head 48 are selected to cooperate with specific pocket dimensions, the shoulder 50 will slide between the vertical edges 22 and will gradually be seated on the horizontal pocket edge 24 and the rivet head 48 which had a diameter greater than the distance between the vertical pocket edges 22 will be restrained against lateral inward movement and against forward and rearward movement relative to the associated standard.

In this manner, a conventional shelf may be inexpensively adapted for use with pocket-bearing standards, eliminating the cost and complexity of making multicomponent shelves heretofore necessarily and routinely employed in pocket bearing systems of the type discussed above.

From the foregoing, it will be apparent to those of ordinary skill in the art that modifications may be made without departing from the spirit and scope of the invention. Accordingly, the present invention is not intended to be limited except as may be necessary in view of the appended claims.

What is claimed is:

1. In a shelving system having a plurality of vertical standards arranged in a rectangular array, each standard having an inwardly facing inner surface defining a vertically spaced series of upwardly opening pockets, each of said pockets on each said standard projecting inwardly of said rectangular array and inwardly of the array from said inner surface, said pockets defining formation for engaging a shelf, and wherein a set of pockets, one on each of said standards, is used to engage, support and retain a shelf at each of its four corners on a said rectangular array, a shelf, said shelf being substantially rectangular and being integrally formed from a single sheet of steel to provide a main shelf surface and front, rear and opposite side edges, said front and rear edges merging into downwardly extending front and rear hollow box-beam reinforcing formations, and said side edges merging into downwardly projecting side panels, said shelf having four corners, and said shelf further having flaps integral with said shelf extending rearwardly from adjacent said front edges and forwardly from adjacent said rear edges and lying in overlapping relationship with said side panels at each of the four corners, in each of the four corners, a pair of aligned openings, one formed in each side panel and an adjacent overlapping flap, and a circular rivet secured in each of said pair of aligned openings, each said rivet having a head, said rivet head projecting outwardly of said side edge, and wherein a set of four rivets is positioned to overlie and engage a set of pockets, and to cooperate therewith to support a shelf in said set of pockets, and to retain a shelf in said rectangular array.

2. A shelving system in accordance with claim 1, and wherein said rivets are shoulder rivets.

3. A shelving system in accordance with claim 1, and wherein each of said pocket formations includes a pair of spaced-apart generally vertical edges terminating at their lower ends in a lower support edge extending between the lower ends of said vertical edges and wherein the distance between said spaced-apart vertical edges is less than the diameter of the rivet head, whereby when said heads are moved downwardly and positioned in said pockets, they are restrained against movement inwardly of the array and out of said pockets.

4. A shelving system in accordance with claim 3 and wherein said rivets are rivets having shoulders, and the diameters of said shoulders are less than the distance between said spaced-apart vertical edges.

* * * * *